US006118260A

United States Patent [19]

Kirkpatrick, II et al.

[11] Patent Number: 6,118,260

[45] Date of Patent: Sep. 12, 2000

[54] SUPPLY CURRENT REGULATOR FOR TWO-WIRE SENSORS

[75] Inventors: Richard Allen Kirkpatrick, II; Mark Robert Plagens, both of Dallas, Tex.

[73] Assignee: Honeywell International Inc, Morristown, N.J.

[21] Appl. No.: 09/429,445

[22] Filed: Oct. 28, 1999

[51] Int. Cl.[7] ..... G05F 3/04

[52] U.S. Cl. ..... 323/312

[58] Field of Search ..... 323/269, 273, 323/277, 282, 312, 364, 367

[56] References Cited

U.S. PATENT DOCUMENTS 4,446,417 5/1984 Fox et al. ..... 322/25

5,917,312 6/1999 Brkovic ..... 323/282

5,973,936 10/1999 Lenz et al. ..... 363/15

*Primary Examiner*—Matthew Nguyen

*Attorney, Agent, or Firm*—Marshall, O'Toole, Gerstein, Murray & Borun

[57] ABSTRACT

A current regulator is provided for a two wire sensor and comprises first and second conductors arranged to provide a sensor output current, a first resistance and a current reference coupled across the first and second conductors, and a second resistance and sensor load terminals coupled across the first and second conductors. An amplifier has first and second inputs and an output. The first input is coupled to a first junction between the first resistance and the current reference, the second input is coupled to a second junction between the second resistance and the sensor load terminals, and the output is connected to the second input. The amplifier controls a first voltage at the first junction to be substantially equal to a second voltage at the second junction.

34 Claims, 2 Drawing Sheets

SUPPLY CURRENT REGULATOR FOR TWO-WIRE SENSORS

TECHNICAL FIELD OF THE INVENTION

The present invention relates generally to supply current regulators for two wire sensors.

BACKGROUND OF THE INVENTION AND PRIOR ART

A two wire sensor is commonly used to sense a condition and to transmit a measure of the sensed condition over two wires to a controller or indicator. The two wire sensor is typically supplied with a voltage $V_S$ over two wires, and the two wire sensor controls the supply current $I_S$ in response to the sensed condition. This supply current $I_S$ is detected by a controller in order to control a load, and/or the supply current $I_S$ is detected by an indicator in order to give an indication of the condition being sensed.

Existing current sources for two wire sensors exhibit several problems. For example, fluctuations in the supply voltage $V_S$ results in corresponding fluctuations in the supply current $I_S$. Because such fluctuations of the supply current $I_S$ are not related to the condition being sensed, the output of the two wire sensor is not an accurate representation of the sensed condition. Also, existing current sources are sensitive to temperature. Therefore, if temperature is not the condition being sensed, the output of the two wire sensor may fluctuate with temperature changes producing an inaccurate indication of the condition being sensed.

Moreover, variations in the current drawn by the transducers of prior art two wire sensors, as well as by the circuitry associated with the transducers, can also produce inaccurate indications of the condition being sensed. A transducer and its associated circuitry of a two wire sensor are referred to herein as a sensor load.

The present invention is directed to an arrangement which solves one or more of the problems of prior art two wire sensor current sources.

SUMMARY OF THE INVENTION

In accordance with one aspect of the present invention, a current regulator for a two wire sensor comprises first and second conductors, a first resistance, a second resistance, and an amplifier. The first and second conductors are arranged to provide a sensor output current. The first resistance and a current reference are coupled across the first and second conductors. The second resistance and sensor load terminals are coupled across the first and second conductors. The amplifier has first and second inputs and an output. The first input is coupled to a first junction between the first resistance and the current reference, the second input is coupled to a second junction between the second resistance and the sensor load terminals, and the output is connected so as to control the sensor output current in the first and second conductors. The amplifier is arranged so that a first voltage at the first junction is substantially equal to a second voltage at the second junction.

In accordance with another aspect of the present invention, a current regulator for a two wire sensor comprises first and second conductors, a current reference, sensor load terminals, and an amplifier. The first and second conductors are arranged to provide a sensor output current. The current reference is coupled to the first and second conductors. The sensor load terminals are coupled to the first and second conductors. The amplifier is coupled between the current reference and the sensor load terminals in a closed loop feedback configuration so that the current reference is controlled so as to vary the sensor output current in relation to a sensed condition.

In accordance with yet another aspect of the present invention, a current regulator for a two wire sensor comprises first and second conductors, a current reference, and a sensor load. The first and second conductors are arranged to provide a sensor output current. The current reference is coupled to the first and second conductors, and the current reference comprises a plurality of components. The sensor load is coupled to the first and second conductors and to the current reference. The sensor load includes a voltage regulator, and the sensor load is arranged to control the current reference so as to control the sensor output current. The current reference is coupled to the voltage regulator so as to render the current regulator substantially supply voltage insensitive, and the components are selected so as to render the current regulator substantially temperature insensitive.

BRIEF DESCRIPTION OF THE DRAWINGS

The features and advantages of the present invention will become more apparent upon a reading of the following description in conjunction with the drawings in which.

DESCRIPTION OF THE PREFERRED EMBODIMENTS

Figure 1:
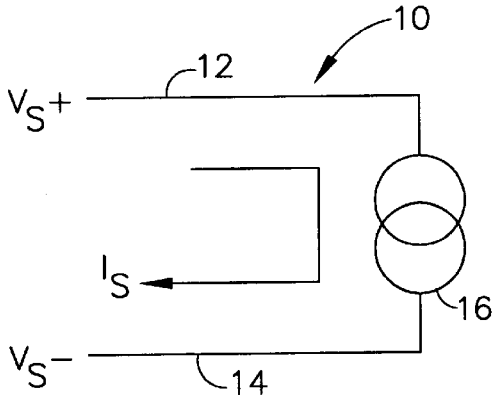
FIG. 1 is a general diagram of a current loop for use in connection with a two wire sensor.

As shown in FIG. 1, a two wire sensor 10 typically comprises a pair of conductors 12 and 14 connected to a sensor/regulator 16. A voltage $V_S$ is provided across the conductors 12 and 14, and the sensor/regulator 16 controls a supply current $I_S$ in accordance with a condition being sensed. The supply current $I_S$, therefore, is detected from the conductors 12 and 14 and is used by a controller to control the sensed condition and/or by an indicator to indicate the sensed condition.

Figure 2:
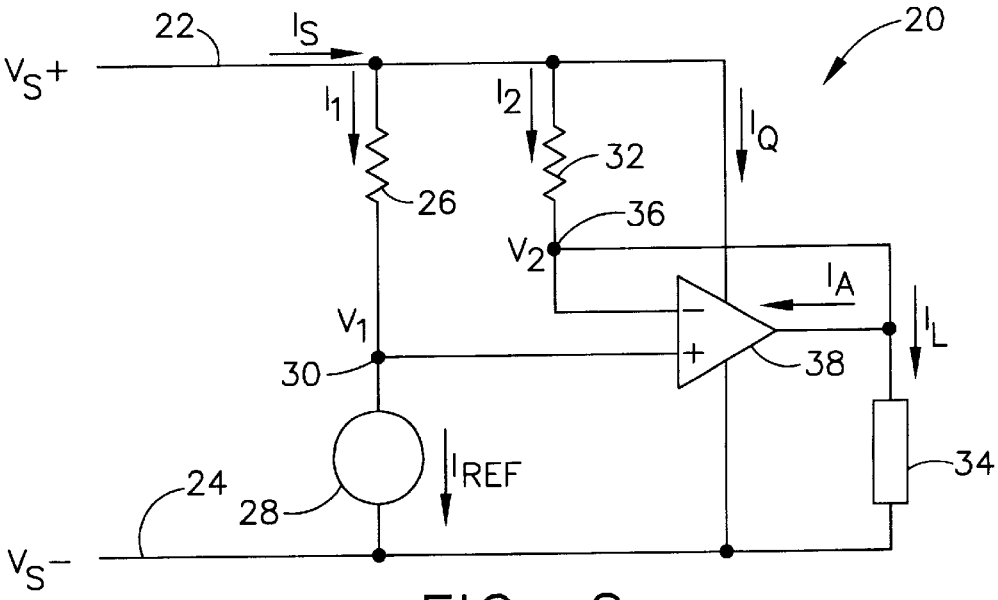
FIG. 2 illustrates a circuit diagram of a current regulator according to the present invention and including a current reference and a sensor load.

A two wire sensor 20 in accordance with the present invention is shown in FIG. 2. The two wire sensor 20 includes a pair of conductors 22 and 24. A voltage $V_S$ is provided across the conductors 22 and 24. Also connected across the conductors 22 and 24 are a first resistance 26 and a current reference 28 having a junction 30 therebetween. The current reference 28 provides a current $I_{REF}$ such that the current $I_1$ through the first resistance 26 and the current $I_{REF}$ are substantially related according to the following equation:

$$I_1=I_{REF} \tag{1}$$

Also, a voltage $V_1$ at the junction 30 is given by the following equation:

$$V_1=V_S-(I_{REF})(R_1) \tag{2}$$

where $R_1$ is the resistance of the first resistance 26.

A second resistance 32 and a sensor load 34 are connected across the conductors 22 and 24 and form a junction 36 therebetween. As discussed hereinafter, the sensor load 34 includes a transducer that transduces the desired condition. An operational transconductance amplifier 38 (OTA) has a first input connected to the junction 30, a second input connected to the junction 36, and an output also connected to the junction 36.

A voltage $V_2$ at the junction 36 is given by the following equation:

$$V_2=V_1-V_{OS} \tag{3}$$

where $V_{OS}$ is small and is the input offset voltage of the operational transconductance amplifier 38. Thus, the negative feedback and high gain of the operational transconductance amplifier 38 forces the voltage $V_2$ to be substantially equal to the voltage $V_1$. Moreover, a current $I_2$ flows through the second resistance 32 and is given by the following equation:

$$I_2 = \frac{(V_S - V_2)}{R_2} \tag{4}$$

where $R_2$ is the resistance of the second resistance 32.

According to Kirchoff's current law, the supply current $I_S$ in the conductors 22 and 24 is related to the current $I_1$ and the current $I_2$ by the following equation:

$$I_S=I_1+I_2+I_Q \tag{5}$$

where $I_Q$ is the quiescent current draw of the operational transconductance amplifier 38 and is shown in FIG. 2. Combining equations (1)–(5) produces the following equation:

$$I_S = I_{REF}\left(1 + \frac{R_1}{R_2}\right) + \frac{V_{OS}}{R_2} + I_Q \tag{6}$$

FIG. 2 also shows a current $I_L$ through the sensor load 34 and a current $I_A$ into the output of the operational transconductance amplifier 38. As the current $I_L$ varies due to transducer operation, the current $I_A$ compensates to maintain a regulated value for the current $I_2$. As can be seen from equation (6), the supply current $I_S$ is substantially a function of only the current $I_{REF}$ and the ratio of $R_1$ to $R_2$, if it is assumed that the offset voltage $V_{OS}$ and the quiescent current $I_Q$ are minimized. The quiescent current $I_Q$ can be minimized, for example, by biasing the operational transconductance amplifier 38 at the voltage $V_2$ instead of at the supply voltage $V_S$ as shown in FIG. 2.

As discussed above, it is highly desirable for the current $I_{REF}$ supplied by the current reference 28 to be insensitive to fluctuations of the supply voltage $V_S$ and to fluctuations of temperature (unless temperature is the condition being sensed). Therefore, as discussed below, the current reference 28 is constructed to be substantially insensitive to fluctuations of the supply voltage $V_S$ and of temperature. The ratio of $R_1$ to $R_2$ is used only as a scaling factor. Accordingly, the current reference 28 provides the desired encoding of the supply current $I_S$ so as to indicate only the condition being sensed.

Figure 3:
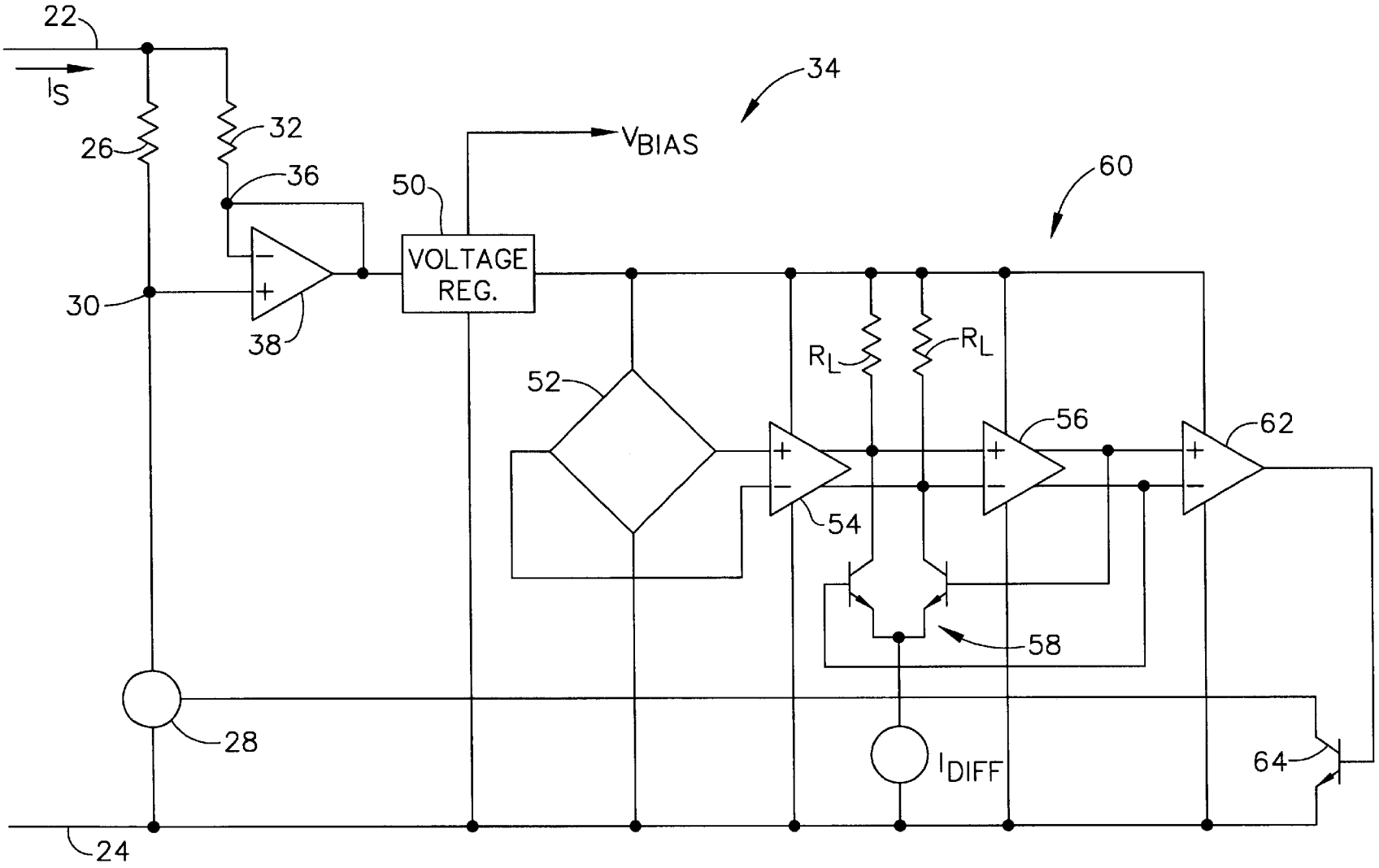
FIG. 3 illustrates the sensor load of FIG. 2 in additional detail.

The sensor load 34, as shown in more detail in FIG. 3, includes a bandgap voltage regulator 50 which provides a regulated voltage to the remainder of the sensor load 34 and to the current reference 28. A transducer 52 is connected to the output of the voltage regulator 50, and converts the sensed condition into an electrical signal that is a measure of the sensed condition and that is supplied to an input of a resistively loaded differential amplifier 54.

The transducer 52, for example, may be a wheatstone bridge which is comprised of resistors fabricated with Permalloy and which converts a differential magnetic flux density into an electrical signal that is fed to the differential amplifier 54. This type of transducer, in conjunction with a ring magnet, is particularly useful in sensing the speed of rotation of a rotating device such as a wheel. As the ring magnet rotates, its rotating pole pieces produce output pulses from the wheatstone bridge that alternately switch the outputs of the differential amplifier 54 between high and low states. However, it should be understood that the transducer 52 may be arranged otherwise in order to sense rotation or any other condition.

The differential amplifier 54, together with a comparator 56 and a hysteresis generator 58, form a threshold switch 60. The hysteresis generator 58 is a saturated differential amplifier having collectors which pull the bias current $I_{DIFF}$ through one or the other of the load resistors $R_L$ of the differential amplifier 54, thus creating an offset voltage which the output of the transducer 52 must overcome before the comparator 56 can switch. When the comparator 56 switches, the hysteresis generator 58 saturates in the opposite condition creating a hysteresis (i.e., a differential) which the transducer 52 must overcome before the comparator 56 can again switch.

The outputs of the comparator 56 are connected to a differential-to-single-ended amplifier 62 which drives the base of a transistor switch 64. As the threshold switch 60 switches between its two output states, the base of the transistor switch 64 is operated by the amplifier 62 between a shorted state, in which the base and emitter of the transistor switch 64 are essentially shorted together, and an over driven state. In the shorted state, the collector of the transistor switch 64 is a high impedance and the transistor switch 64 is open. In the over driven state, the collector of the transistor switch 64 is driven into low impedance saturation and the transistor switch 64 is closed. As will be discussed below, the transistor switch 64 modifies the current $I_{REF}$ provided by the current reference 28 so as to encode the supply current $I_S$ between two levels.

Figure 4:
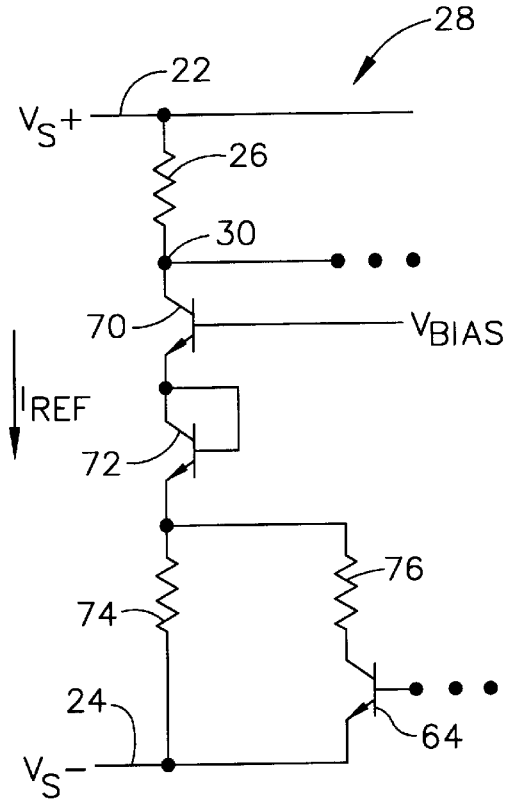
FIG. 4 illustrates the current reference of FIG. 2 in additional detail.

The current reference 28, as shown in more detail in FIG. 4, includes transistors 70 and 72 and resistances 74 and 76. The transistor 70 has its collector connected to the junction 30, its emitter connected to the transistor 72, and its base connected to the voltage regulator 50 to receive a bias voltage $V_{BIAS}$. The collector and base of the transistor 72 are tied together so that the transistor 72 functions as a diode. The resistance 74 is connected between the emitter of the transistor 72 and the conductor 24, and the resistance 76 is connected between the emitter of the transistor 72 and the collector of the transistor switch 64.

As the transistor switch 64 switches between its open and closed states, the circuit of the resistance 76 is opened and closed. When the circuit of the resistance 76 is closed, the resistances 74 and 76 are in parallel such that their combined value is lower than the value of the resistance 74 alone. Therefore, the current $I_{REF}$ assumes its high state. Consequently, the supply current $I_S$ assumes its high state. When the circuit of the resistance 76 is open, the resistance 76 is disconnected from the resistance 74 such that their combined value becomes the value of the resistance 74. Therefore, the current $I_{REF}$ assumes its low state. Consequently, the supply current $I_S$ assumes its low state.

Because the transistor 70 is controlled by the voltage regulator 50, the sensitivity of the voltage across the resistances 74 and 76 to fluctuations of the supply voltage $V_S$ is minimized.

Moreover, the sensitivity of the reference current $I_{REF}$ to fluctuations of temperature is minimized by proper selection of the components of the current reference 28. For example, to minimize the sensitivity of the reference current $I_{REF}$ to temperature, the sensitivity of the voltage at the emitter of the transistor 72 to temperature must equal the sensitivity of the resistances 74 and 76 to temperature. This equalization can be achieved by forming the resistances 74 and 76 from a material with a temperature coefficient of resistance (TCR) that is nearly proportional to absolute temperature (PTAT) and by choosing the voltage level of $V_{BIAS}$ which results in the voltage at the emitter of the transistor 72 being PTAT. Thus, if the temperature coefficient of resistance (TCR) of the resistances 74 and 76 vary in accordance with T, and if the voltage across the resistances 74 and 76 also varies with T, then $I_{REF}$ will be substantially insensitive to temperature fluctuations.

Certain modifications of the present invention have been discussed above. Other modifications will occur to those practicing in the art of the present invention. For example, according to the description above, the threshold switch 60 drives the supply current $I_S$ between two levels as a function of the output of the transducer 52. However, it should be understood that the supply current $I_S$ can be driven to any number of discrete states, or the supply current $I_S$ can be controlled so that it is smoothly varying. A smoothly varying current is equivalent to a current having a very large number of discrete steps.

Moreover, a specific arrangement is described above that minimizes the sensitivity of the reference current $I_{REF}$ to fluctuations of temperature. However, those skilled in the art will understand that other arrangements can be used to achieve this sensitivity minimization.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. A current regulator for a two wire sensor comprising:

first and second conductors arranged to provide a sensor output current;

a first resistance and a current reference coupled across the first and second conductors;

a second resistance and sensor load terminals coupled across the first and second conductors; and, an amplifier having first and second inputs and an output, wherein the first input is coupled to a first junction between the first resistance and the current reference, wherein the second input is coupled to a second junction between the second resistance and the sensor load terminals, wherein the output is connected so as to control the sensor output current in the first and second conductors, and wherein the amplifier is arranged so that a first voltage at the first junction is substantially equal to a second voltage at the second junction.

2. The current regulator of claim 1 wherein the output is coupled to the second input.

3. The current regulator of claim 1 wherein a sensor load is coupled to the sensor load terminals, and wherein the sensor load is coupled to the current reference so as to control the sensor output current.

4. The current regulator of claim 3 wherein the current reference includes a variable resistance coupled between the first junction and one of the first and second conductors, and wherein the variable resistance is coupled to the sensor load so as to control the sensor output current.

5. The current regulator of claim 4 wherein the output is coupled to the second input.

6. The current regulator of claim 4 wherein the sensor load includes a switch arranged to switch the variable resistance between only two discrete resistances.

7. The current regulator of claim 4 wherein the sensor load includes a switch arranged to switch the variable resistance between a plurality of discrete resistances.

8. The current regulator of claim 4 wherein the amplifier is an operational amplifier.

9. The current regulator of claim 1 wherein the amplifier is an operational amplifier.

10. The current regulator of claim 9 wherein the output is coupled to the second input.

11. A current regulator for a two wire sensor comprising:

first and second conductors arranged to provide a sensor output current;

a current reference coupled to the first and second conductors;

sensor load terminals coupled to the first and second conductors; and, an amplifier coupled between the current reference and the sensor load terminals in a closed loop feedback configuration so that the current reference is controlled so as to vary the sensor output current in relation to a sensed condition.

12. The current regulator of claim 11 wherein the amplifier has first and second inputs and an output, wherein the first input is coupled to the current reference, and wherein the output is coupled to the second input and to the sensor load terminals.

13. The current regulator of claim 12 wherein the amplifier is an operational amplifier.

14. The current regulator of claim 11 wherein a sensor load is coupled to the sensor load terminals, and wherein the sensor load is coupled to the current reference so as to control the sensor output current.

15. The current regulator of claim 14 wherein the current reference includes a variable resistance, and wherein the variable resistance is coupled to the sensor load so as to control the sensor output current.

16. The current regulator of claim 15 wherein the sensor load includes a switch arranged to switch the variable resistance between only two discrete resistances.

17. The current regulator of claim 15 wherein the sensor load includes a switch arranged to switch the variable resistance between a plurality of discrete resistances.

18. The current regulator of claim 15 wherein the amplifier is an operational amplifier.

19. The current regulator of claim 15 wherein the amplifier has first and second inputs and an output, wherein the first input is coupled to the current reference, and wherein the output is coupled to the second input and to the sensor load terminals.

20. The current regulator of claim 19 wherein the amplifier is an operational amplifier.

21. A current regulator for a two wire sensor comprising:

first and second conductors arranged to provide a sensor output current;

a current reference coupled to the first and second conductors, wherein the current reference comprises a plurality of components; and, a sensor load coupled to the first and second conductors and to the current reference, wherein the sensor load includes a voltage regulator, wherein the sensor load is arranged to control the current reference so as to control the sensor output current, wherein the current reference is coupled to the voltage regulator so as to render the current regulator substantially supply voltage insensitive, and wherein the components are selected so as to render the current regulator substantially temperature insensitive.

22. The current regulator of claim 21 wherein one of the components is a variable resistance, wherein the variable resistance is coupled to the sensor load, and wherein the sensor load varies the variable resistance so as to control the sensor output current.

23. The current regulator of claim 22 wherein the variable resistance varies with temperature in a first direction, and wherein another of the components varies with temperature in substantially the same direction.

24. The current regulator of claim 22 wherein another of the components is a voltage control device responsive to the voltage regulator so as to maintain the current regulator substantially insensitive to changes in supply voltage.

25. The current regulator of claim 24 wherein the variable resistance varies with temperature in a first direction, and wherein another of the components varies with temperature in substantially the same direction.

26. The current regulator of claim 22 wherein the sensor load includes a switch arranged to switch the variable resistance between only two discrete resistances.

27. The current regulator of claim 22 wherein the sensor load includes a switch arranged to switch the variable resistance between a plurality of discrete resistances.

28. The current regulator of claim 21 further comprising:

a first resistance arranged to couple the current reference across the first and second conductors;

a second resistance arranged to couple the sensor load across the first and second conductors; and, an amplifier having first and second inputs and an output, wherein the first input is coupled to a first junction between the first resistance and the current reference, wherein the second input is coupled to a second junction between the second resistance and the sensor load, and wherein the amplifier is arranged so that a first voltage at the first junction is substantially equal to a second voltage at the second junction.

29. The current regulator of claim 28 wherein the output is coupled to the second input.

30. The current regulator of claim 28 wherein the amplifier is an operational amplifier.

31. The current regulator of claim 28 wherein one of the components is a variable resistance coupled between the first junction and one of the first and second conductors, and wherein the variable resistance is coupled to the sensor load so as to control the sensor output current.

32. The current regulator of claim 31 wherein the variable resistance varies with temperature in a first direction, and wherein another of the components varies with temperature in substantially the same direction.

33. The current regulator of claim 31 wherein another of the components is a voltage control device responsive to the voltage regulator so as to maintain the current regulator substantially insensitive to changes in supply voltage.

34. The current regulator of claim 33 wherein the variable resistance varies with temperature in a first direction, and wherein another of the components varies with temperature in substantially the same direction.

* * * * *